United States Patent [19]

Chalik

[11] Patent Number: 4,646,495

[45] Date of Patent: Mar. 3, 1987

[54] COMPOSITE LOAD-BEARING SYSTEM FOR MODULAR BUILDINGS

[76] Inventor: Rachil Chalik, 10 Edgebrook Dr., West Hartford, Conn. 06117

[21] Appl. No.: 682,694

[22] Filed: Dec. 17, 1984

[51] Int. Cl.[4] ..... E04H 1/00

[52] U.S. Cl. ..... 52/236.8; 52/236.7; 52/236.3; 52/259

[58] Field of Search ..... 52/236.8, 236.7, 236.3, 52/259, 220

[56] References Cited

U.S. PATENT DOCUMENTS

| | | | |
|---|---|---|---|
| 1,171,400 | 2/1916 | Hoge | 52/236.8 |
| 1,254,109 | 1/1918 | Atterbury | 52/236.7 |
| 1,501,288 | 7/1924 | Morley | 52/236.8 |
| 1,924,801 | 8/1933 | Olmsted | 52/236.8 |
| 1,987,115 | 1/1935 | Kotrbaty | 52/236.8 |
| 2,178,097 | 10/1939 | Davison et al. | 52/601 |
| 2,741,908 | 4/1956 | Swanson | 52/602 |
| 3,063,202 | 11/1962 | Carper | 52/595 |
| 3,110,982 | 11/1963 | Besinger | 52/648 |
| 3,495,371 | 2/1970 | Mitchell, Jr. | 52/236.7 |
| 3,562,979 | 2/1971 | Oglu | 52/236.8 |
| 3,613,325 | 10/1971 | Yee | 52/236.8 |
| 3,638,380 | 2/1972 | Perri | 52/79.12 |
| 3,712,007 | 1/1973 | Krimp | 52/79.12 |
| 3,712,008 | 1/1973 | Georgio et al. | 52/79.12 |
| 3,748,805 | 7/1973 | Boros | 52/236.8 |
| 3,780,480 | 12/1973 | Cvijanovic et al. | 52/259 |
| 3,992,828 | 11/1976 | Ohe | 52/69 |
| 4,186,535 | 2/1980 | Morton | 52/795 |
| 4,192,623 | 3/1980 | Borg | 52/702 |
| 4,282,690 | 8/1981 | Meheen | 52/79.11 |
| 4,341,051 | 7/1982 | Sim et al. | 52/702 |

FOREIGN PATENT DOCUMENTS

| | | | |
|---|---|---|---|
| 817517 | 12/1951 | Fed. Rep. of Germany | 52/236 |
| 1299838 | 7/1969 | Fed. Rep. of Germany | 52/236.8 |

*Primary Examiner*—Carl D. Friedman
*Assistant Examiner*—Michael Safavi

[57] ABSTRACT

A load-bearing building system employing a plurality of standard steel columns and a plurality of precast reinforced concrete slabs of certain standard room sizes. A plurality of such slabs are mounted at every floor elevation in side by side relationship. Concrete is then poured between adjacent slabs to provide, together with ribs of the slabs, a load-resisting space frame and floor decks serving simultaneously as horizontal diaphragms and room ceilings. The slabs are two-way flat plates having perimeter ribs reinforced with bars and light gauge corrugated steel which serve as shear reinforcement and as non-reuseable framework for the ribs. The slabs are each supported at four points. The space frame's composite girders comprises steel reinforcement together with poured-in-place and prefabricated concrete acting integrally. This construction has special moment connections, providing positive bending in the girders, regardless of the horizontal load direction. A small variety of sizes of standard slabs and steel columns are capable of being assembled to form a large variety of different buildings.

7 Claims, 19 Drawing Figures

COMPOSITE LOAD-BEARING SYSTEM FOR MODULAR BUILDINGS

BACKGROUND OF THE INVENTION

This invention relates to modular multiple-story buildings, intended for human occupancy, such as apartment buildings, hotels, schools, dormitories, offices and any buildings with a plurality of repetitive room sizes, where the prefabricated standard elements can be used.

Such buildings are usually characterized by regular floor patterns and arrangement of columns, extending through all stories, so a system of beams and girders on columns forms a multi-story skeleton frame which supports the outside walls, roof and floor elements or prefabricated box-like modules and resists all vertical and horizontal loads imposed upon the building. The lateral (wind or seismic) loads are usually assumed to act as a concentrated forces applied at the floor and roof levels and distributed to rigid or braced frames, shear walls or other vertical load-resisting elements providing building stability. Therefore, the floor and roof deck systems of a plurality of slabs and beams act between lateral supports like a beam, loaded in a horizontal plane (horizontal diaphragm). To properly perform the diaphragm function it is essential that the integrity of all prefabricated elements is accomplished. Such integrity can be attained by welding special mechanical connectors to steel inserts embedded in every precast concrete element. The commonly used reinforced concrete floor and roof precast slabs are narrow (flat, ribbed, waffle, hollow-core, single or double tees), and the numbers of the joints between them is significant. Due to the plurality of inserts, connectors and field welded welding spots, this method is expensive and protracted. More frequently, the cast-in-place floor-topping concrete with wire mesh reinforcement is used. This procedure has an inherently relatively high labor content during on-building-site assembly and additional spending of concrete and steel. By using prefabricated modules and beams, the horizontal load translation can be accomplished by the longitudinal beams.

The prior art includes building lateral supports which are either rigid or braced frames or walls constructed according to necessity which withstand all horizontal loads and provide vertical supports for floors. The braced frames use pin connections and vertical braces such as cross braces or K-braces to make a more rigid structure. The walls and braced frames are, of course, sometimes undesirable since they may interrupt the space which would desirably be left open. All rigid frames use moment connections which restrict turn between columns and girders and produce a rigid construction. The larger the building, the larger the girders, because wind loads on larger buildings are greater.

Joists may extend between the girders and plates may sit on the joists to sustain the required load. One of the most common types of floor construction is the slab-joist-girder system with a one-way slab. The dead and live load acting on such slabs are transferred in the short direction hence the main reinforcement is parallel to the short side of the slab and the deflected surface is primarily one of single curvature. If the slab is supported at least on three edges and the ratio of the long span to the short span is less than about two, the loads are transferred in both directions and the deflected surface becomes one of double curvature, the slab is defined as a two-way slab. In two-way concrete slabs the main reinforcement usually runs in two directions.

The required distance between lateral load-resisting supports depends on the intensity of loads, and the working capacity of supports and diaphragms.

However, the frequently installed lateral walls and braced frames subdivide the space and, thus, constrain architectural decisions. A rigid frame structure can span large openings and provide the design flexibility. Due to reversible direction of wind and seismic loads, the rigid frame elements, and particularly the field assembled girders and their moment-connected ends must be designed for both negative and positive bendings. (Assuming that the negative bending produces tension in the upper part of the girder and compression in the lower part, and positive bending acts in opposite directions.) A negative moment at a support, as a result of the horizontal and vertical loads, appears to be much bigger than a positive moment which is produced only by horizontal loads. The concrete girder and its end joints, proportioned to the worst loading condition, are complicated and cumbersome. The bending in a negative direction is a critical design consideration because of a lack of concrete in compression zones (especially in prestressed construction, where the lower portion of the girders already have been compressed by manufacturing). The composite action of a concrete plate located on the top of the girders is useless for negative moment restriction.

Accordingly, contrary to the preference of architectural designers, the lateral supports in known high rise buildings, which are heavily loaded by horizontal loads, are cumbersome and the distance between them is limited by the shear resistance offered by diaphragms and by the capacity of the supports.

Most commonly used floor and roof systems are used with a suspended ceiling. Such ceilings are necessary to hide the ribs or joists between adjacent precast slabs.

In part, the space above the suspended ceiling and below the associated slabs is used for pipes and conduits. The utilization efficiency of this space (like the efficiency of the extra space between horizontal levels of prefabricated modules, separately supported by beams) is usually low.

Among all the advantages of prefabricated building systems, there are two important difficulties as compared to poured concrete constructions. They are: (1) transportation of prefabricated elements and (2) obtaining the structural system integrity and stability. It is clear that the structural systems which are assembled from a plurality of separate members are more difficult to make stable and have the required integrity.

By increasing sizes of elements from large numbers of standard manufactured building parts to box-shaped, room-sized modules completely prefabricated in a shop, the time and labor required for assembling can be saved, but the expenses for transportation and erection will rise. But the total expenses can be minimized by using the optimum number of elements having optimum sizes.

The prior art includes the following U.S. Pat. Nos. 3,992,828; 3,712,008; 3,712,007; 3,638,380; 4,282,690; 4,341,051; 4,192,623; 4,186,535; 2,741,908; 3,110,982; 3,063,202; and 2,178,097.

It is an object of the present invention to provide an improved structural building system, comprised of prefabricated structural elements of optional unobstructive sizes, suitable for manufacturing, transportation, erection and assembling with a minimum of field labor and building construction time.

It is another object of the present invention to provide a relatively small number of different types of prefabricated building components, suitable for assembling a large number of various building designs and layouts.

It is a further object of the present invention to provide a stable prefabricated structural system by using rigid frames with composite girders and horizontal diaphragms accommodating precast floor slabs, which collectively act with a high degree of integrity.

It is a further object of the present invention to provide efficient load distribution by employing two-way slabs for floor elements and special frame connections which transmit bending moments in one direction only, providing positive bending of girders, appropriate for the properties and possibilities of reinforced concrete.

It is still another object of the present invention to replace the conventional cumbersome lateral supports by light rigid frames, providing big vertical apertures regardless of building height and loading conditions.

Another object of the present invention is to provide a composite girder, which employs the precast concrete floor slabs in composite action together with poured-in-place concrete and steel reinforcement.

A still further object of the present invention is to provide the high efficiency of the building space by using the room-size flat plates and eliminating wasted space between floor bearing construction and the suspended ceiling.

It is a further object of the present invention to eliminate the ceiling and to provide the utilization of the smooth underside of the floor slabs, which may be painted directly and left exposed for the ceiling.

SUMMARY OF THE INVENTION

The foregoing objects and other objects and advantages which shall become apparent from the detailed description of the preferred embodiment are attained in the load-bearing system of the invention comprising a plurality of steel columns, assembled in rigid frames, which are specifically configured to withstand all expected loads and to provide stability; a plurality of prefabricated reinforced concrete slabs, corresponding to habitation areas, such as rooms and assembled to form horizontal diaphragms and composite girders interconnected between the columns by special connections, constructed to transmit bending moments in positive directions and perform as a pin connection by bending in negative directions.

The moment connections, in accordance with the invention, avoid reversible stresses in girders of rigid frames experiencing the action of reversable horizontal loads. The design and manufacturing of the structural connections are inexpensive and easy. The slabs are substantially flat plates and have corrugated steel covered perimeter ribs which can be produced under factory conditions in precasting yards constructed on the site or within reasonable shipping distances.

All joints between precast slabs, as well as the girder-to-column positive moment connections are composite. The framework for cast-in-place concrete consists of slab ribs and a minimum number of reusable boards, suspended between already erected slabs. The arrangement of moment connections and joints requires minimum field (construction site) work.

The two-way concrete slab has, except for the depending rib extending around the perimeter, no permanent parts projecting below the lower surface of the central portions thereof. Accordingly, a slab surface can be used as the ceiling of the room area below the slab. Elimination of the suspended ceiling decreases the construction depth of each floor with resultant savings in the overall height of building.

The perimeter ribs of the slab are partially hidden by partitions and partially form the inner cornice.

BRIEF DESCRIPTION OF THE DRAWING

The invention will be better understood by reference to the accompanying drawing in which.

DESCRIPTION OF THE PREFERRED EMBODIMENTS

Figure 1:
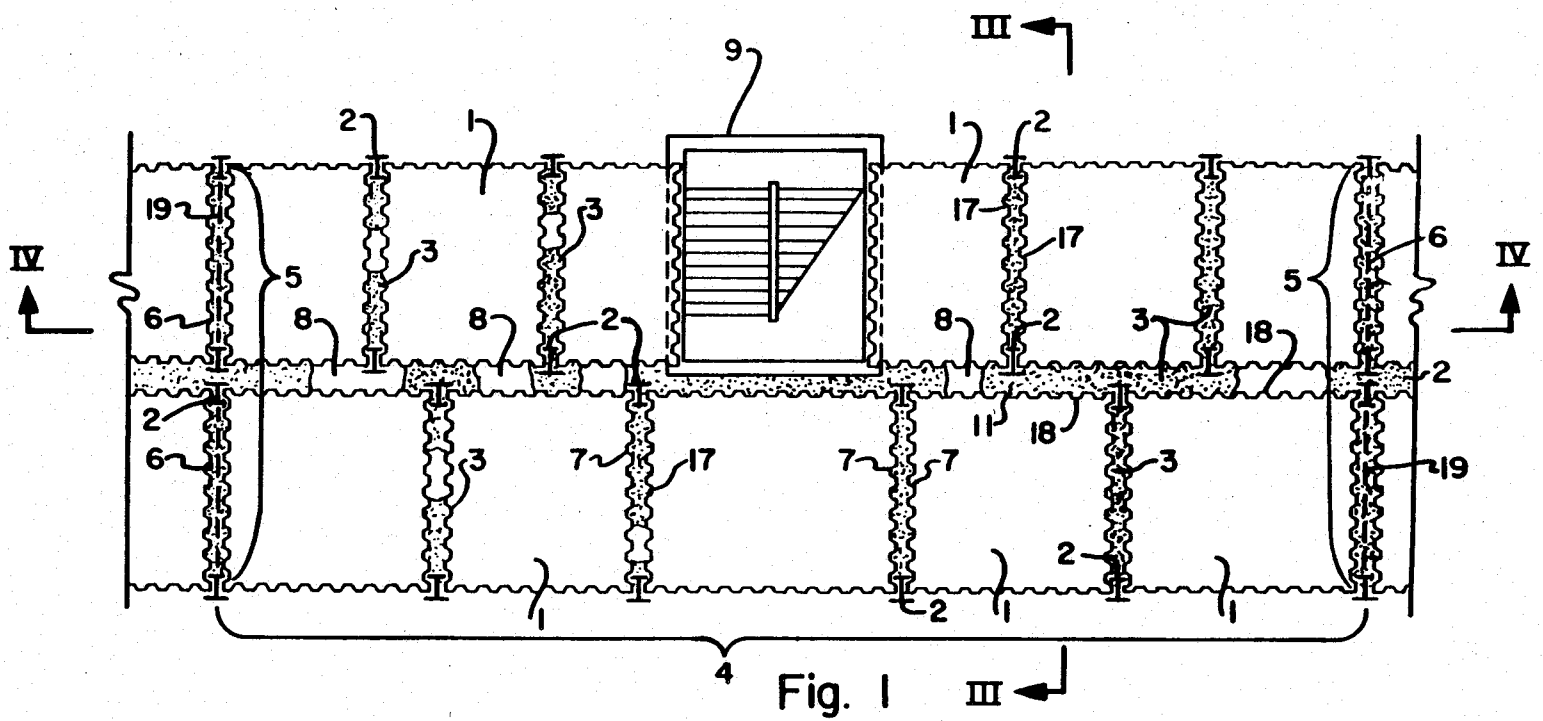
FIG. 1 is a partially schematic typical plan view of a building in accordance with the invention having longitudinal openings in the floor deck to pass plumbing systems incorporated in longitudinal partitions.
Figure 2:
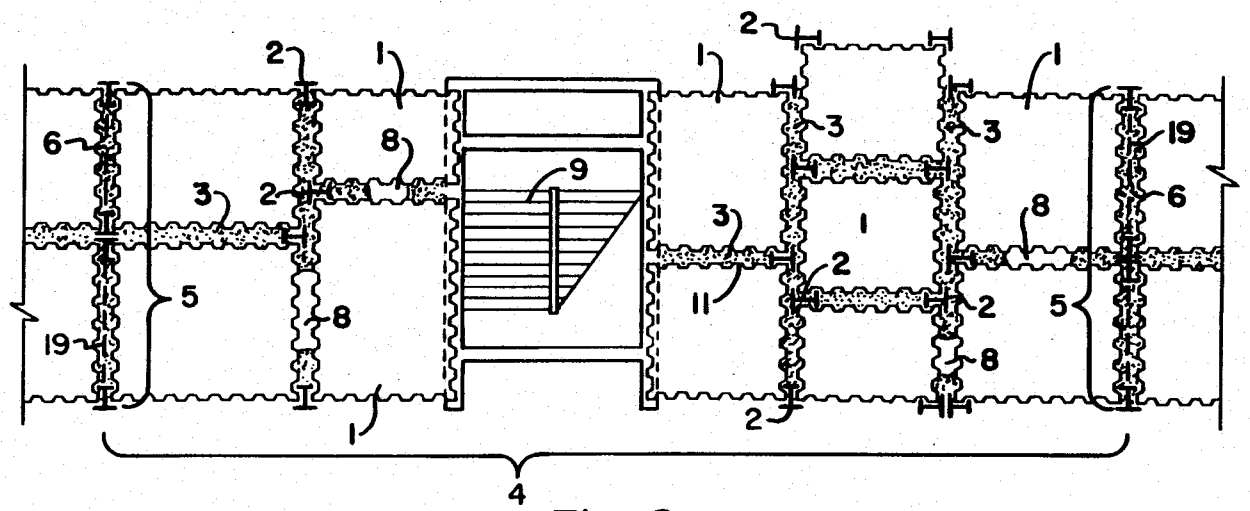
FIG. 2 is a partially schematic typical plan view of a part of a building in accordance with the invention having transverse openings in the floor deck to pass the plumbing systems incorporated in transverse partitions.

Referring to FIGS. 1 and 2, the load-bearing system of the invention comprise a plurality of floor slabs 1, resting on steel columns 2 and resisting vertical loads. The slabs 1 at each elevation forms together with concrete 3 poured between them, horizontal diaphragms 4 which transfer imposed horizontal loads to rigid frames located at both ends of the diaphragm 4 and performing as vertical supports 5. These rigid frames provide the building stability and comprise the steel columns 2 and composite girders 6. The composite girders 6 are concrete flexural members employing precast reinforced concrete slabs 1, cast-in-place concrete 3 and steel members 19 so interconnected by cast-in-place concrete 3 that all elements respond to loads as a unit. In accordance with the invention, every prefabricated floor slab 1 has dimensions corresponding to the size of a room. In such a modular building there is a plurality of repetitive standard room sizes corresponding to the respective slab 1 sizes, the relatively small number of different slab 1 sizes can be assembled in a wide variety of configurations, providing many different layouts.

Figure 3:
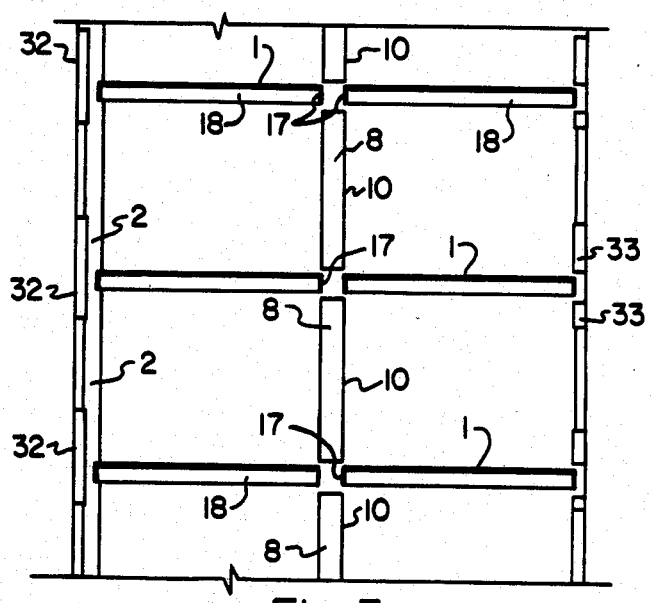
FIG. 3 is a partially schematic transverse sectional view taken along the line III—III of FIG. 1, which illustrates the location of the longitudinal partitions, installed on the prefabricated floor slabs, supported by a double row of columns.
Figure 4:
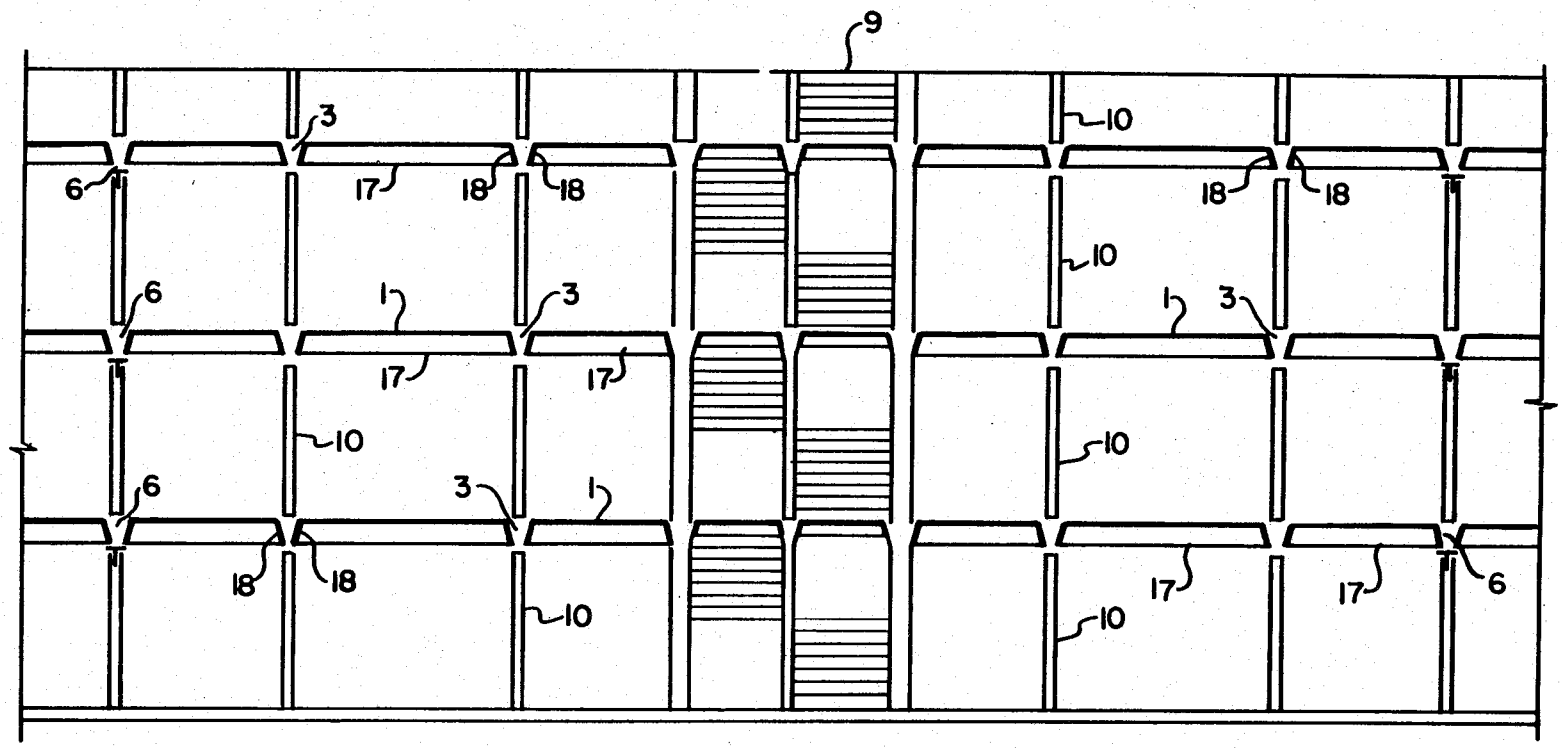
FIG. 4 is a partially schematic longitudinal sectional view taken along the line IV—IV of FIG. 1, which illustrates the location of the transverse partitions, installed on the prefabricated floor slabs, supported by single rows of columns.
Figure 16:
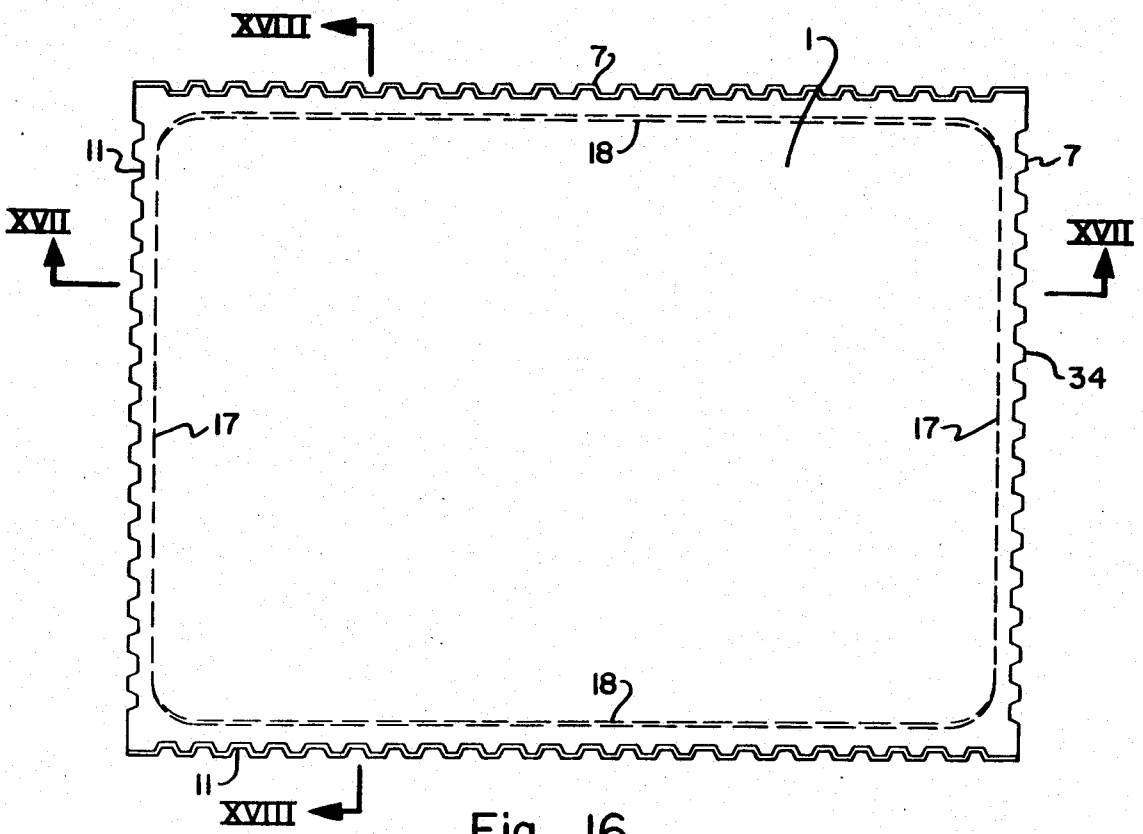
FIG. 16 is a partially schematic plan view of a floor slab.
Figure 17:
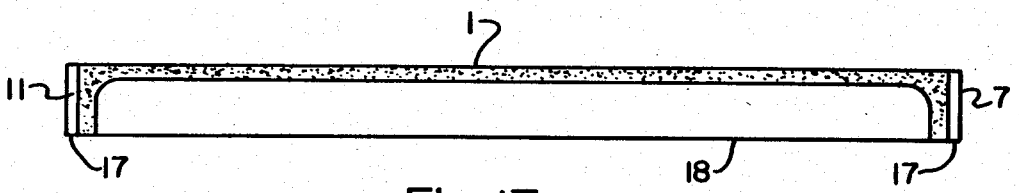
FIG. 17 is a partially schematic cross-sectional view, taken along the line XVII—XVII in FIG. 16.
Figure 18:
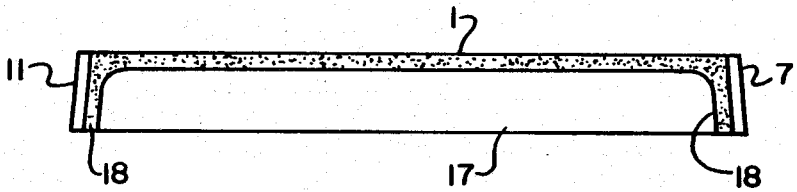
FIG. 18 is partially schematic cross-sectional view, taken along the line XVIII—XVIII in FIG. 16.
Figure 19:
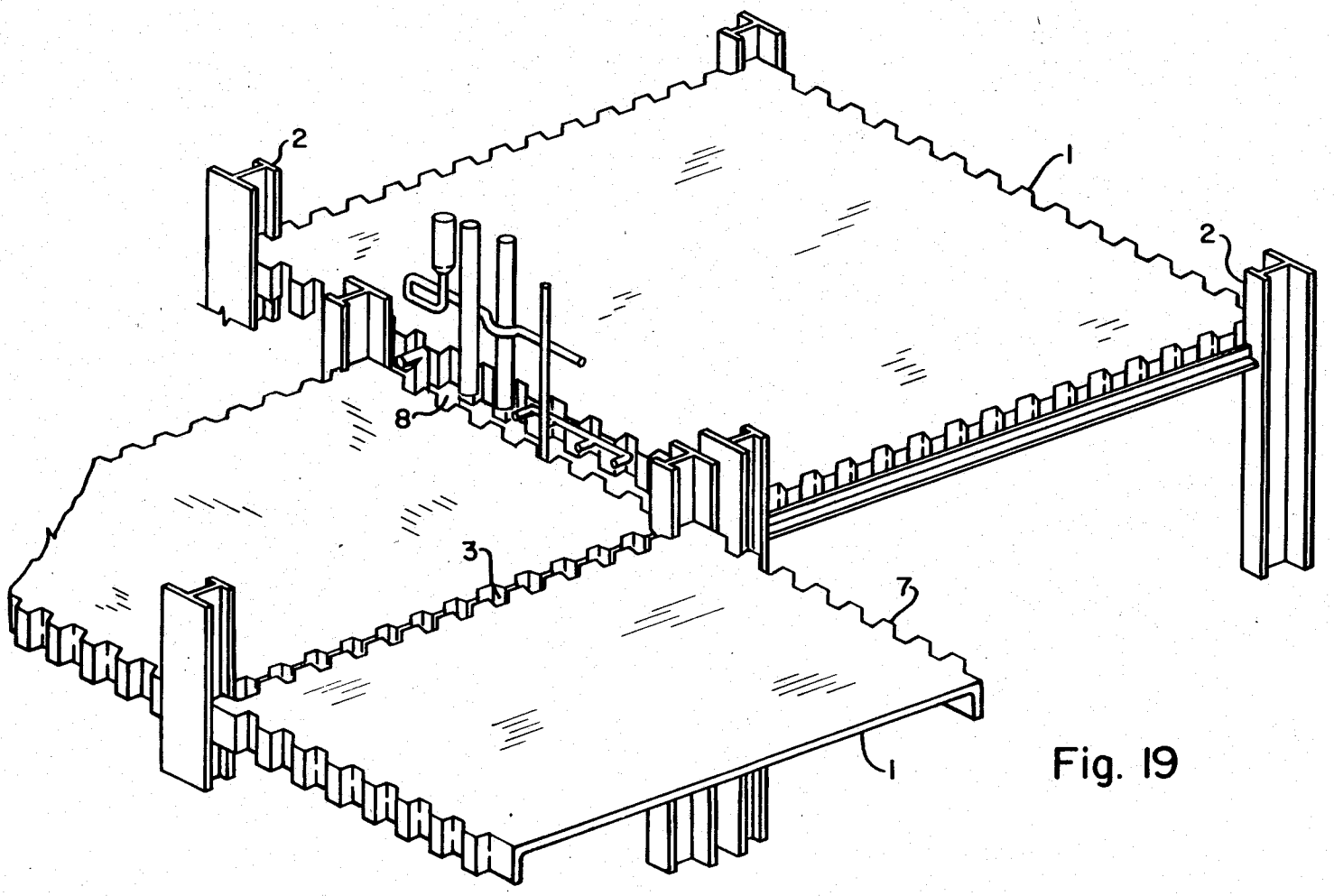
FIG. 19 is a partially schematic perspective view showing a portion of a building in accordance with the invention.

FIGS. 1 and 2 illustrated the slab assemblies corresponded to longitudinal and transversal respectively, alignments of utility containing partitions (10 in FIG. 3). Every slab 1 is supported at each corner thereof by a steel column 2. The elimination of prefabricated beams and girders reduces the field (on site) labor required for floor member assembling and joint arrangement. The integrity of the floor system and resistance to horizontal shear loads is accomplished by concrete 3, poured between the slabs 1. The slabs 1, as shown in FIGS. 16, 17, and 18, include corrugated outer steel surfaces 7. The corrugated surfaces 7 on ribs 17, 18 prevent lateral displacement of the slabs 1 and provide grooves 11 for the small utility openings. Relatively large utility passages 8 are defined between the adjacent slabs 1 supported by different rows of the columns 2. The passages 8 are for vertical plumbing, stairs, gas pipes, and the like, as shown in FIG. 19. The width of these openings 8 may be of any size because of the preferred column 2 arrangement. Each built-up steel column 2 supports only two slabs 1. The distances between the columns 2 along the outside walls correspond to the size of the slab 1 with which they cooperate and, thus, to room size. Along every utility containing opening 8 between the adjacent slabs 1, 1, two rows of the columns 2 are installed. The width requirement of the utility containing opening 8 determines the lateral distance between the adjacent rows of columns 2. According to the architectural requirements the double column 2 rows can be located lengthwise (FIG. 1) or throughout (FIG. 2).

A stair-cage 9 can be constructed as a vertical-load resisting system, vertical-and-horizontal-load resisting system, or a non-load resisting system, with adjacent slabs 1 supported by the columns 2. The load-bearing system of the invention can be utilized with any kind of nonbearing or self-supported exterior walls and partitions 10. (In FIG. 3 there are shown panel walls 32 suspended between the columns 2 and curtain walls 33 supported at every level by the slabs 1.

Figure 5:
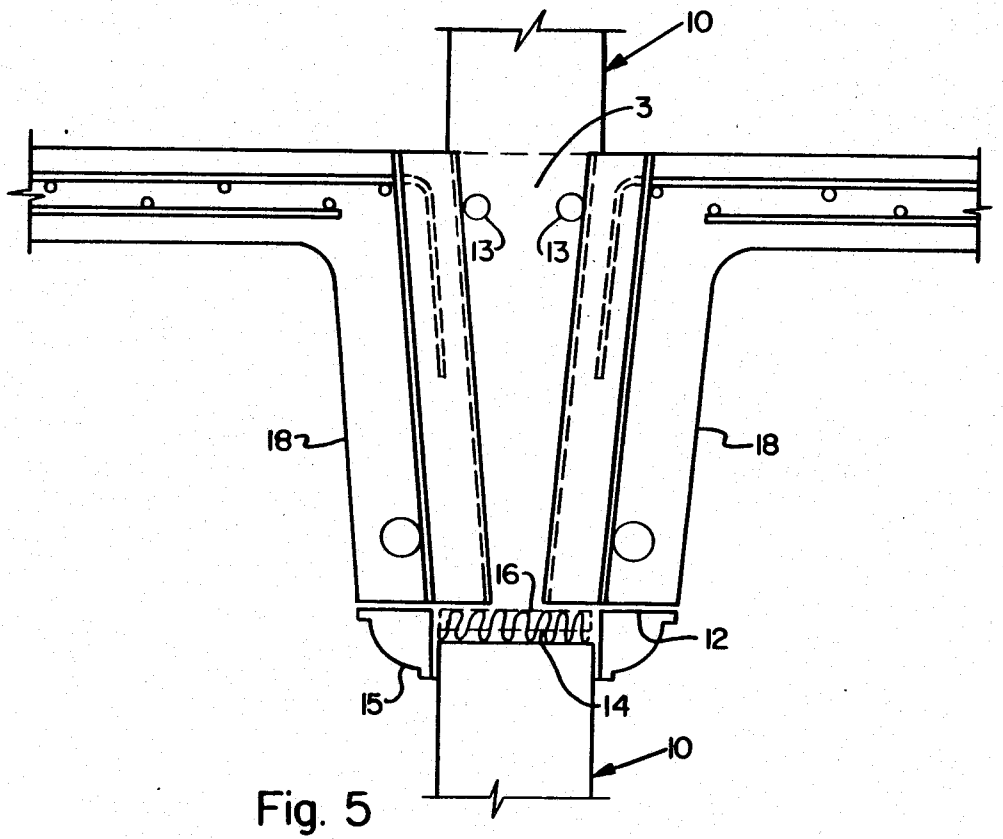
FIG. 5 is a partially schematic detailed cross-sectional view, to an enlarged scale, of a standard composite joint of slabs supported by common columns in accordance with the invention.

As shown in FIGS. 3, 4, 5 and 6, the partitions 10 above and below every given floor are vertically aligned and the slab ribs 17, 18 are located in abutting relation to the partitions 10. The total thickness of the two ribs 17 or 18, including minimum space for the concrete 3 fill between them is usually bigger than the partition 10 size (see FIG. 5). Thus, a small part of the ribs 17 or 18 extend inside the rooms of the structure in accordance with the invention. Accordingly, the ribs 17 or 18 form a cornice-like structure 12. In FIG. 5 there are shown two bars 13, welded to two outer steel surfaces 7 of the ribs before erection of the slab 1. These bars 13 provide the redistribution of vertical live loads and the integral action of the adjacent slabs 1. The clearance for vertical deflection of the slabs 1 is filled up with insulation 14 and covered by moldings 15. Also, the bars 13 can be used for supports of hangers of suspended reusable board 16, serving as a framework for the cast-in-place concrete 3.

Every slab 1 has two vertical ribs 17 and two sloped ribs 18, as seen in FIGS. 16–18. The vertical ribs 17, 17 are more suitable for openings and the sloped ribs 18, 18 are more suitable for the cast-in-place concrete 3 installation. As will be apparent from FIG. 6, the width of the partition 10 above and under the openings between the ribs 17, 17 may be increased to provide the necessary space 8 for utilities and a certain size of cornice 12.

Figure 6:
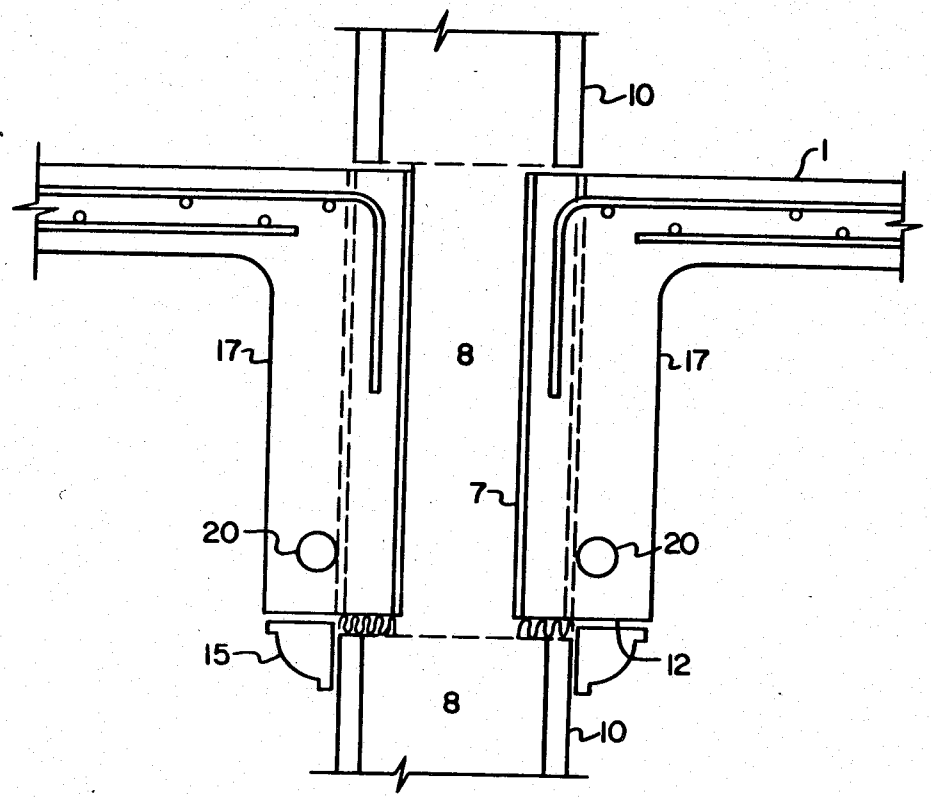
FIG. 6 is a partially schematic cross-sectional view of an opening between two adjacent slabs, supported by separate columns.

The space 8, shown in FIG. 6, may be filled up between openings with the concrete 3. To prevent slipping between cast-in-place concrete 3 and the slab 1 short bars may be welded to outer surfaces of the ribs.

Figure 7:
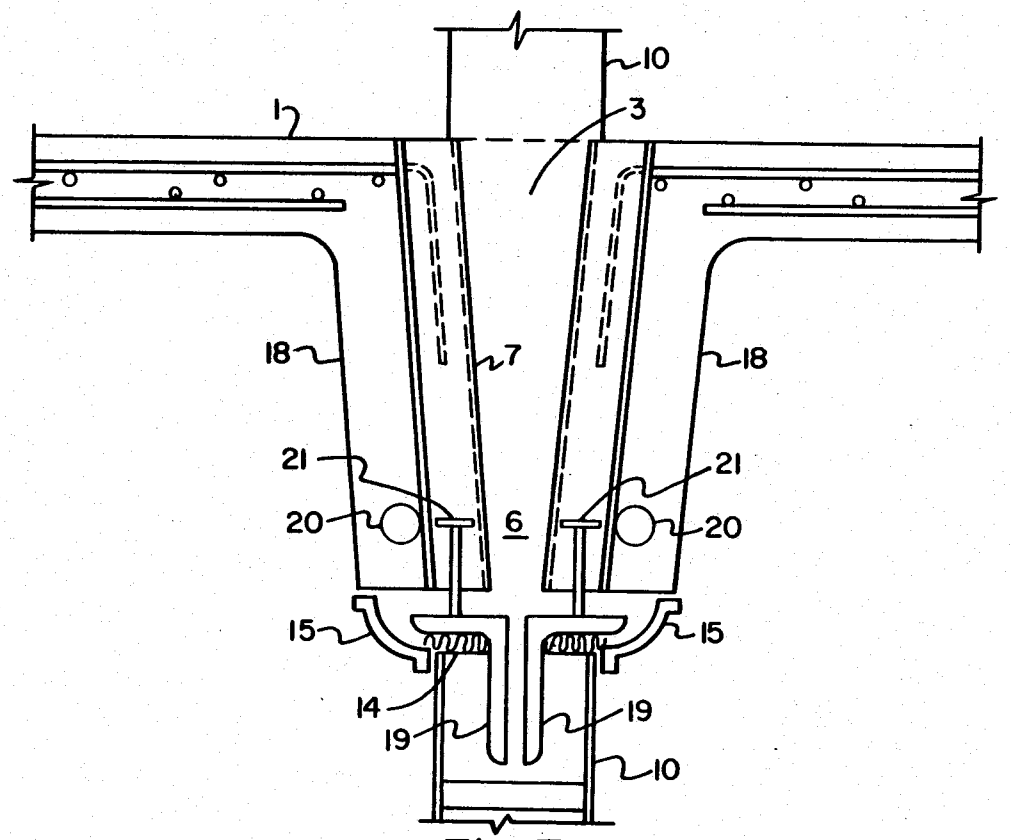
FIG. 7 is a partially schematic cross-sectional view of a composite frame girder, reinforced with two angles.

Referring to FIG. 7, there is shown a tee-shaped composite frame girder, formed by reinforcing the commonly assembled slab joint with field installed reinforcement 19 spanning between the columns 2. As illustrated in FIG. 7, the composite girder 6 includes the structural steel elements 19. Such, or similar, rigid reinforcement, projecting very little below the ribs 18, 18 and being thinner than the partition 10 can be easily hidden in it and practically does not reduce the capability to provide large openings.

According to an imposed horizontal loads and the height of the building, the rigid frames 5 can be installed as often as necessary without any restrictions on architectural possibilities. Thus, in contrast with common structural systems, an increase in load range does not increase the girder 6 size, but only affects the girder 6 spacing.

The composite action of precast concrete slabs 1 resisting the compression and steel reinforcement comprises structural angles 19 and bars 20 located within the ribs 18 and resisting the flexural tension provides an efficient resistance to bending in positive direction.

Figure 8:
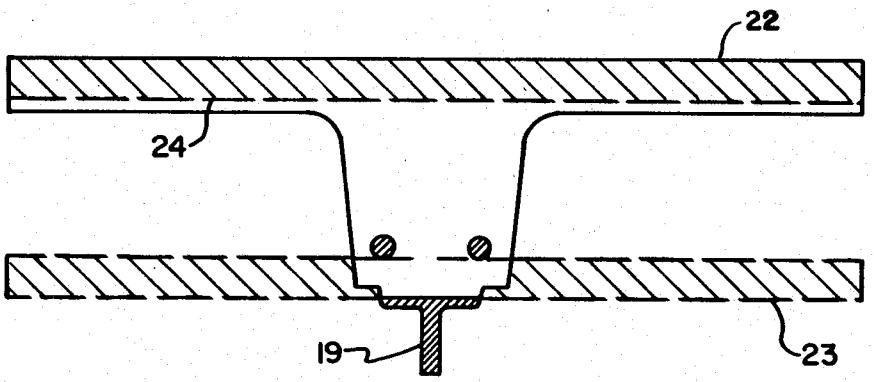
FIG. 8 is a partially schematic cracked transformed section of a composite girder.

FIG. 8 illustrates a cracked transformed section of a composite girder, where 22 is compression area of concrete, 23 is transformed steel area and 24 is the neutral axis. In the method of transformed section, the section of steel and concrete is transformed into a homogeneous section of only concrete by replacing the actual steel area with the equivalent area (i.e. imaginary area) of concrete. In constructing the transformed section the assumption that concrete does not take tension (concrete cracks under tension) is used.

Figure 9:
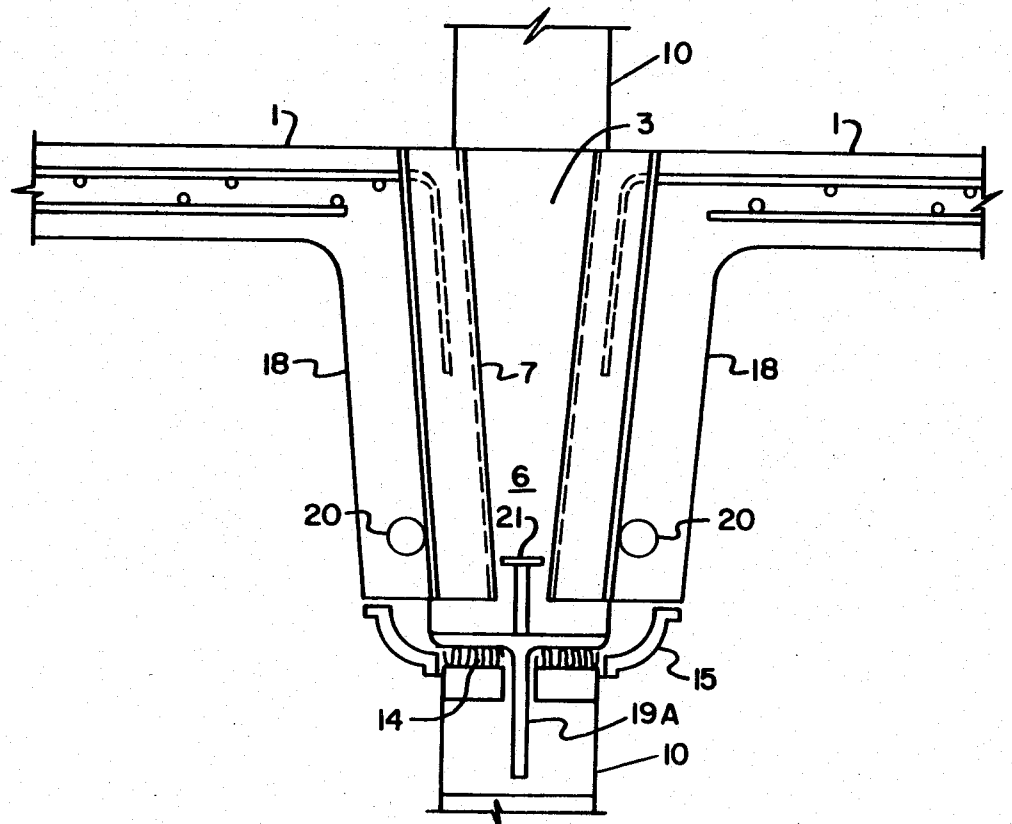
FIG. 9 is a partially schematic cross-sectional view of an alternative composite girder which is refinforced with a structural tee-section.
Figure 10:
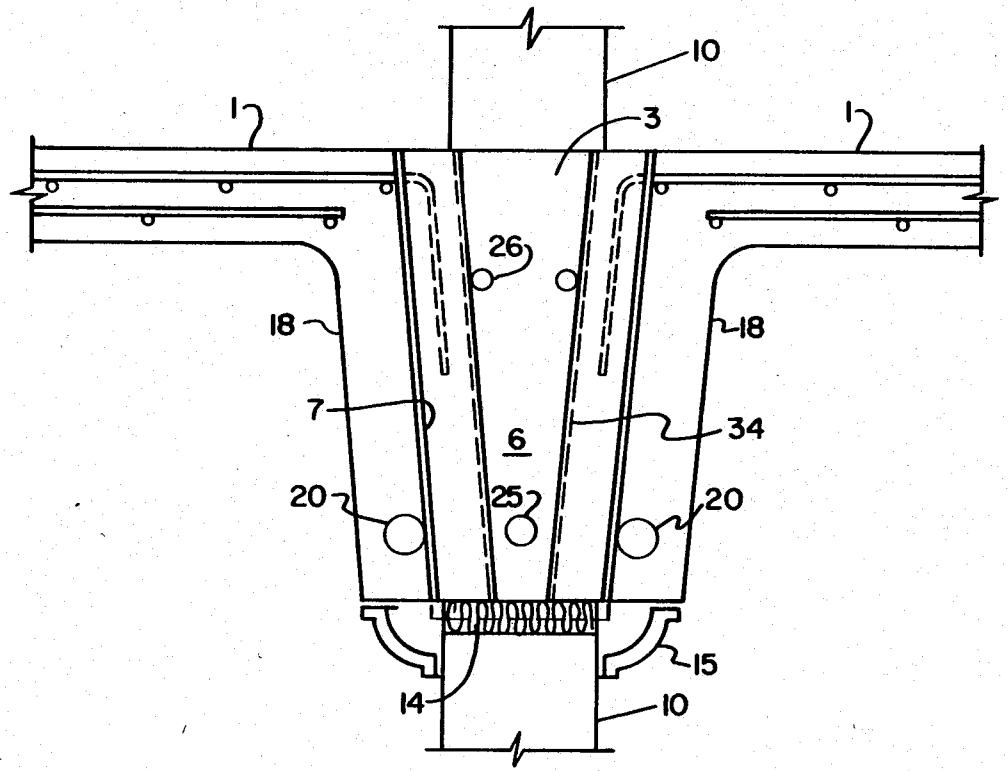
FIG. 10 is a partially schematic cross-sectional view of another alternative solution of a composite girder, reinforced with deformed bar.

As shown in FIGS. 9 and 10, an alternative girder 6 reinforcement may be used. The tee-shaped steel reinforcement 19A will ordinarily be installed and secured by bolts (not shown) to the columns 2 (not shown) before erection of the slabs 1. After the slabs 1 are installed, the concrete 3 is poured in the space between them. In this initial stage, every slab 1 works separately, and the ribs 18, and 18 each act as simple pin-connected beams, loaded with vertical forces. Only after setting of concrete, all components of the composite girder 6 will work integrally, performing as a unit and providing the design capacity required for the worst combination of actual loads. The integrity of two prefabricated concrete slabs 1 and steel reinforcement 19A is obtained by hardening the poured-in-place concrete 3. The lateral forces are resisted by the corrugated shapes 7 of outside surfaces of the ribs 18 and stud bolts 21 welded to the tee-shape steel reinforcement 19A and acted as shear connectors. Alternative shear connectors can be used. (For example, the usual ribbed reinforcement bars 25 may be encased in the concrete 3 and no shear connectors are required as shown in FIG. 10). The vertical displacement of the cast-in-place concrete 3 is prevented by its trapezium shape, and the horizontal of connectors 19 or 19A preclude the separate deflection of the slabs 1. If the stem is reinforced with a bar 25, the additional short bars 26 are welded in the prefabrication shop to the outer surfaces of the ribs 18, as shown in FIG. 10. (These bars 26 are intended to preclude the separate deflection of slabs). Sometimes, when the ratio of dead load to life load is very small, the special steel connectors shall be welded between the ribs 18 to prevent the longitudinal crack in concrete caused by torsion.

Figure 11:
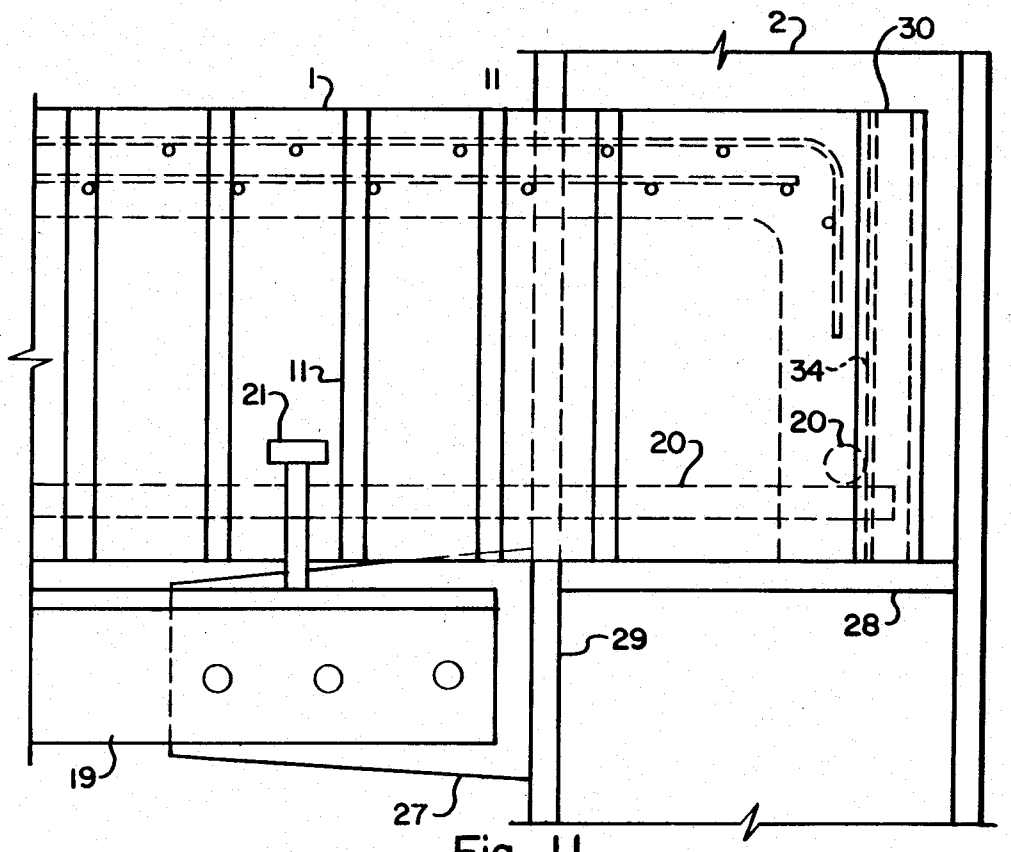
FIG. 11 is a partially schematic section of a frame girder positive moment connection in accordance with the invention.
Figure 12:
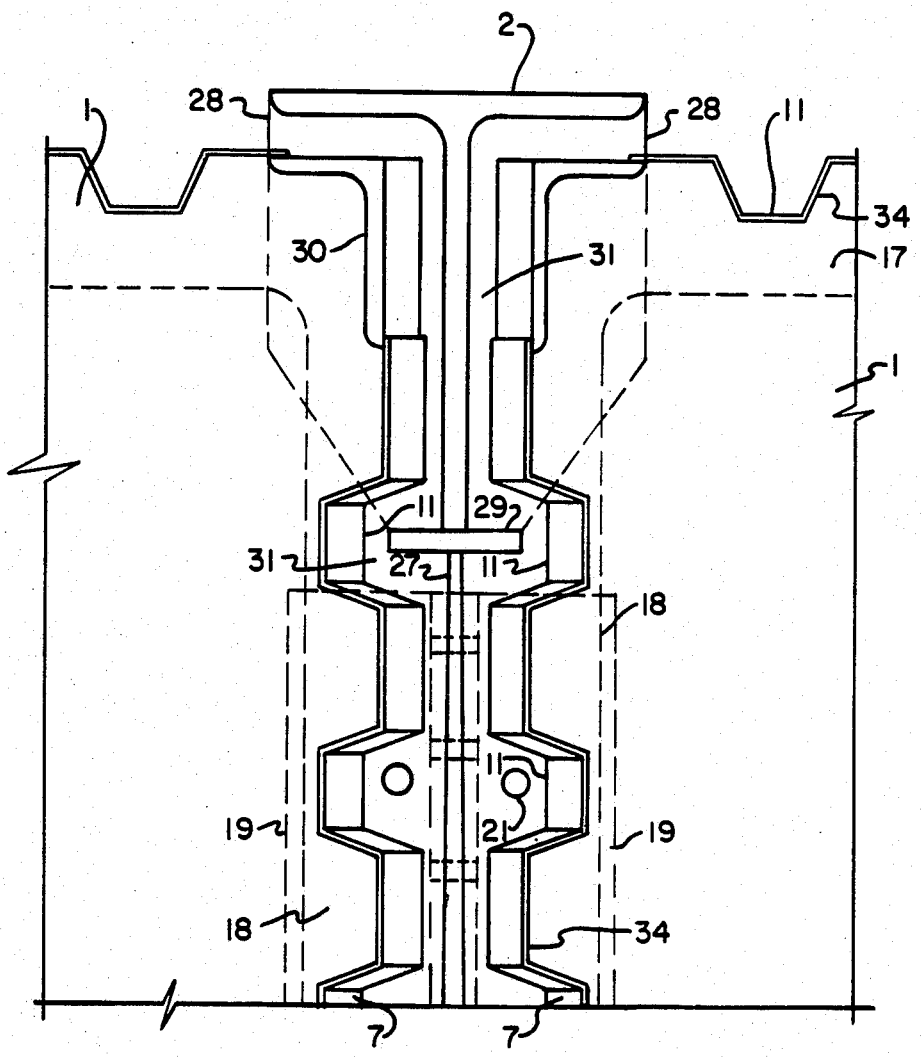
FIG. 12 is a partially schematic plan view of the moment connection shown in FIG. 11.
Figure 13:
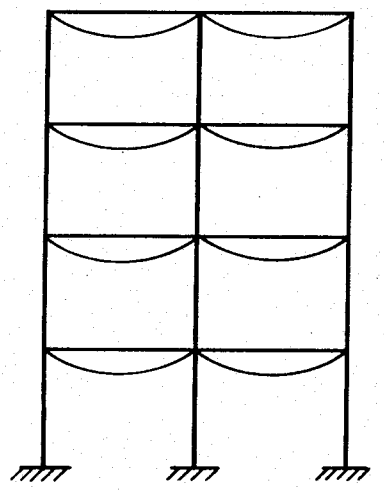
FIG. 13 is a moment diagram of a lateral frame with girder to column connections in accordance with the invention, loaded with vertical loads on the girders.

The maximum effectiveness of the composite girders 6 can be obtained by employing it for positive bending along the entire length of the span. In frame girders of the invention, a moment diagram of this type was achieved by using special composite girder-to-column connections, which are shown in FIGS. 11 and 12. The arrangement of floor deck begins by assembling the outer reinforcement of girders. After the rigid steel reinforcement 19 has been bolted to the gusset 27, all concrete slabs 1 shall be erected on the seat plates 28, shop welded between flanges to the columns 2. Such a location of seat plates 28 is possible because the narrow column flange 29 can be placed in grooves 11, of corrugated rib surfaces 7, shown in FIG. 19. The seat plate 28 is welded along three edges to the column 2, and transmits all vertical loads to column 2 with minimum excentricity. In this stage the slab ribs 18 perform as pin supported beams, bending under the gravity load in positive direction and tending to put the upper portion in compression and the lower portion in tension. The corresponding moment diagram is shown in FIG. 13.

Figure 14:
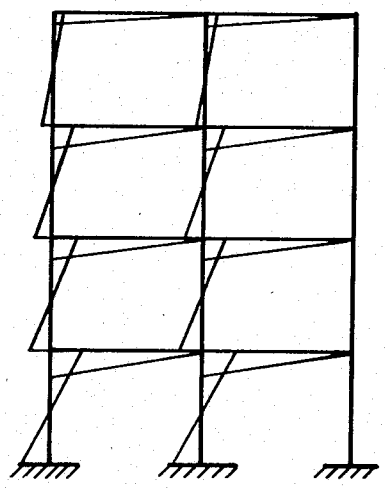
FIG. 14 is a moment diagram of a lateral frame with girder to column connections, in accordance with the invention, loaded with left-to-right horizontal loads.
Figure 15:
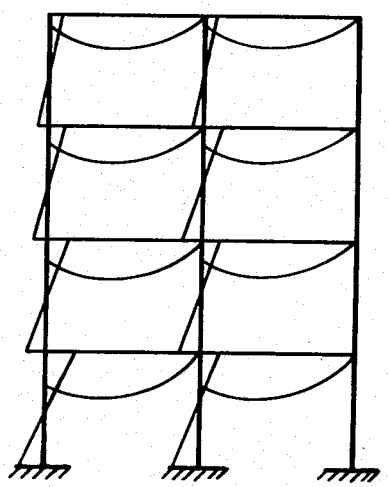
FIG. 15 is a resultant moment diagram of a lateral frame with girder to column connections in accordance with the invention, simultaneously loaded with vertical and left-to-right horizontal loads.

After the concrete 31 poured between slab 1, ribs 18, and 18 and the column 2 hardens and is capable of transmitting the compression load, while the steel reinforcement 19, transmits tension, the composite connections can be assumed completely rigid and capable of maintaining the original angles between girder and columns. Therefore, the proposed connection provides the restriction of bending moment, resulting from continuous structural action by bending in positive direction. In contrast, there is no continuity of girders and columns by bending in negative direction. The tension in the upper portion producing cracks in concrete cannot be restricted by it and the end bending moment is zero. Corresponding moment diagram from left-to-right horizontal loads is shown in FIG. 14. FIG. 15 illustrates the moment diagram resulting from simultaneous action of left-to-right, horizontal, and vertical loads. Therefore, when left-to-right horizontal loads are acting, all the left ends of all of the girders are moment connected to the columns, and all right ends of the same girders are pin-connected. As the load direction changes to the opposite, the joints are changing their actions, and now all left ends of girders are pin-supported at the columns, while the right ends are rigidly tied. But in all cases, no matter in what direction the horizontal loads are acting, the tension stresses are located on the bottom and the compression appears on the upper portion of the girder. Such stress distribution also provides the effective use of prestressed slab ribs (if required). Also, the proposed connections provide the scattering of bending moment diagram along the girder length and decrease the extreme value of bending moment.

The economical efficiency of the present invention is provided by a plurality of mass produced floor slabs 1. FIGS. 16, 17, and 18 illustrate the slab 1 construction in greater detail. Two-way solid slabs 1 supported on all four sides, with main reinforcement running in two directions belong to one of the most effective reinforced concrete constructions. The absence of intermediate ribs eliminates the requirement for suspended ceilings and allows the use of the painted undersurface for a room ceiling, thus, saving materials, space and labor. The suspended ceiling may still be used in selected rooms, such as bathrooms, as it is necessary to get extra space for utilities.

The outside surfaces 7 of the ribs 17, 18 are corrugated. A light gauge corrugated metal (such as steel) decking 34 is used for non-removable framework and shear reinforcement. The decking 34 shape provides integrity of the precast slabs 1 and the concrete 3 between them, permitting elimination of any concrete cover for the rib reinforcement and use of this space for vertical passages 8 provide the convenience of slab 1 supports located between column flanges and let to weld additional bars to outer surfaces of ribs 17, 18, if it is necessary to prevent the slabs 1 from slipping against cast-in-place concrete 3.

The flexural rib reinforcement 20, being embedded in concrete and welded to corrugated steel surface 34, provides the interlocking in the ribs.

The slabs 1 corresponding to the size of an individual room with the depending ribs 17, 18 extending around the perimeter of the room, will be aesthetically unobjectionable as compared, for example, to a more conventional construction which uses a plurality of beams or have depending ribs. The flanges of the column 2 extend between the recesses 11 of the decking 34 which are on the sides of the slabs 1. A steel angle 30 is disposed at the corner of each slab 1 to reinforce that portion of the structure.

The structure in accordance with the invention does not need internal walls to absorb wind loads as in more conventional structure. This is true because the composite girder construction, which consists of the slab ribs, steel elements and cast-in-place concrete is "moment connected" to the columns 2, to produce a rigid frame. The term "moment connected" refers, of course, to a rigid connection as opposed to a pin or pivotal connection.

The construction, in accordance with the invention, does not need any braces, lateral walls, or special supports for stability. Even better, the construction does not need beams which are lower than the ceiling, except relatively small ribs around the periphery of a room. The slab 1 is the flooring for the upper story and the ceiling for the lower story. Unlike conventional structures, no necessity for a dropped ceiling exists.

Corrugated light-weight cold-formed steel deck material with mutually parallel open channels extends along the entire periphery of the slab 1 and depending ribs 17, 18. The corrugated steel perimeter strips 34 are welded to flexural reinforcement bars 20 by several puddle welds, joined together in corners by steel angles 30 and installed in form-work before the placement of concrete. The steel material serves as a form-work and shear reinforcement for ribs.

The moment connection is a novel feature of the invention. The connection between the girders 6 and the columns 2 in each frame restrict tension of the bottom and compression of the top of the girder.

Every building has to be designed to withstand the imposed wind or seismic horizontal loads. Usually this is done with shear walls or braced frames or rigid frames. The shear walls may be interior load bearing walls. The braced frames may utilize diagonal members extending within a rectangular perimeter. Such a construction limits the freedom of design for the architect. Thus, to avoid this constraint, rigid frames are used which use rigidly interconnected girders and columns. In other words, the girder cannot move in a pivotal manner at the connection with the column unlike pinned constructions which allow pivotal movement. A moment connection is always a rigid connection. In a typical moment connection the connection restricts tension on the top and compression on the bottom. Unlike conventional construction, the apparatus in accordance with the invention restricts compression on the top and tension on the bottom.

In this work the following sign convention is used. A moment producing tension in the upper part of girder and compression in the lower part is negative. The positive moment acts in opposite direction and produces opposite stresses.

The FIG. 13, 14, and 15 bending moment diagrams use a line which extends below the girder to indicate the magnitude of bending moment encountered. For example, in FIG. 13 the curved line indicates the maximum positive bending moment occurs at the center of the girder. Referring to FIG. 14, the generally vertical oblique line crossing the column indicates that the moment on the upper portion of the column changes its sign. The resultant moment diagram shown in FIG. 15 indicates that the top of the girder is in compression and the bottom is in tension. It is of great importance to have the top in compression and the bottom in tension because it is easiest to construct a member which has steel on the bottom and concrete on the top because you can easily pour concrete on top of a steel member.

The bending moment diagram of FIG. 15 is unique to the apparatus in accordance with the invention and is attained because there are steel ties located near the bottom of each horizontal element, as opposed to the more conventional structure which has steel ties at the top. Note that the invention is relevant solely to a rigid construction and no prior construction is known that had a rigid construction without a steel connection at the top of each floor.

One aspect of the novelty of the invention is in a new kind of design of moment connections. Such moment connections are opposite to usually used moment connections. The new moment connection is designed in such a way that steel connectors are located at the bottom of the moment connection. The top of the moment connection can restrict only compression, but cannot work for tension. Such a moment connection can work only for positive moment. By bending in the opposite direction the connection works like a pin connection and can rotate without any additional stresses. Advantageously, such a design transfers tension forces at the bottom of a girder and compression forces at the top, no matter in what direction the external loads are applied.

Every particular girder-to-column joint will perform as a rigid moment connection when wind loads act in one direction and as a pin connection when the direction of wind changes to opposite. In FIGS. 14 and 15 are shown that when horizontal wind loads are applied from left-to-right all left ends of girders are moment restricted and all right ends are acting as pin connections. This is possible because the tension restricting steel connectors are located on the bottom of each girder and there are no steel ties on the top, which is contrary to established building practice.

Having thus described my invention, I claim:

1. A load-bearing modular building system, comprising:

a plurality of steel columns, a plurality of room-size prefabricated reinforced concrete slabs having depending ribs along the periphery arranged with adjacent slabs disposed in substantially edge abutting spaced relation, each of said slabs having a plurality of corners, each corner being supported from a column, said slabs being two-way reinforced concrete slabs having only perimeter ribs and a flat underside surface between said ribs, said underside surface suitable for use as a ceiling, said ribs being corrugated in a vertical direction on the outer surface thereof; and cast-in-place concrete poured between said adjacent slabs to form after hardening an integral horizontal diaphragm together with said slabs.

2. A system according to claim 1, further comprising: a plurality of steel connectors disposed intermediate at least a portion of said adjacent slabs near the lower part of said ribs thereof and joining together adjacent columns, each of said connectors, cast-in-place concrete and adjacent ribs or two adjacent prefabricated slabs acting integrally after hardening of cast-in-place concrete to form a composite frame girder.

3. A load-bearing modular building system, comprising:

a plurality of steel columns;

a plurality of room-size prefabricated reinforced concrete slabs having depending ribs along the periphery arranged with adjacent slabs disposed in substantially edge abutting spaced relation, each of said slabs having a plurality of corners, each corner being supported from a column;

cast-in-place concrete poured between said adjacent slabs to form integral horizontal diaphragms together with said ribs; and a plurality of openings formed in the cast-in-place concrete arranged between corrugated outer surfaces of adjacent slabs to provide utility passages between adjacent slabs.

4. A load-bearing modular building system, comprising:

a plurality of steel columns;

a plurality of room-size prefabricated reinforced concrete slabs having depending ribs along the periphery arranged with adjacent slabs disposed in substantially edge abutting spaced relation, each of said slabs having a plurality of corners, each corner being supported from a column;

cast-in-place concrete poured between said adjacent slabs to form integral horizontal diaphragms together with said ribs; and means for supporting said slabs and providing positive moment resisting joints between said horizontal diaphragms and said steel columns, said means comprising horizontal steel plates welded between flanges of said column and supporting two corners of floor slabs, tensile resisting connectors tied between columns, each of said connectors acting after concrete hardening as a reinforcement of one of said horizontal diaphragms, two corners of adjacent slabs supported by the same column having corrugated outer surfaces spaced apart to provide space for a column flange and concrete poured between slabs and the column, said corrugated outer surfaces of said slabs engaging said column flanges said cast-in-place concrete surrounding said column flanges, after hardening, resisting flexural compression, produced by positive bending.

5. A load-bearing modular building system comprising:

a plurality of steel columns;

a plurality of room-size prefabricated reinforced concrete slabs having depending ribs along the periphery thereof disposed in substantially edge abutting spaced relation, said slabs being two-way reinforced concrete slabs having only perimeter ribs and a flat underside surface between said ribs, said surface being employed for a ceiling, said perimeter ribs being corrugated in a vertical direction on the outer surface thereof and having a steel coating on the outer surface thereof, each of said slabs supported at its corners from an adjacent column;

a plurality of steel connectors disposed intermediate at least a portion of adjacent slabs near the lower part of said ribs thereof and joining together adjacent columns; and cast-in-place concrete poured between said slabs to form with said ribs composite frame girders having upper and lower portions extending between adjacent columns thereby forming vertical frames and integral horizontal diaphragms extending between and supported from said columns, each steel connector when present acting after concrete hardening as a tensile resisting reinforcement of the composite frame girder of which it is an integral member.

6. A load-bearing modular building system as recited in claim 5 further comprising:

means for supporting the corners of abutting slabs from an adjacent steel column and providing a positive bending moment resisting joint between said composite frame girder and said adjacent steel column, said means comprising horizontal steel plates welded between flanges of said column and supporting an adjacent corner of each of said abutting slabs, said corrugated perimeter ribs of the corner portions of the abutting slabs engaging a flange of said column therebetween; said tension resisting steel connectors extending between adjacent columns within said composite frame girders; and cast-in-place concrete poured between said abutting slabs and said column about the engaged column flange, said cast-in-place concrete surrounding the engaged column flange, after hardening, resisting flexural compression, produced by positive bending.

7. A load-bearing modular building system is recited in claim 5 wherein said steel connectors extending between adjacent columns in the lower portion of said girder resist the tension component of the positive bending moment couple, and the cast-in-place concrete in the upper portion of said girder after hardening resists the compression component of the positive bending moment.

* * * * *